US007188572B2

(12) United States Patent
Fujihara

(10) Patent No.: US 7,188,572 B2
(45) Date of Patent: Mar. 13, 2007

(54) SAFETY COVER FOR SEWING MACHINE

(75) Inventor: Shinya Fujihara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/385,675

(22) Filed: Mar. 22, 2006

(65) Prior Publication Data

US 2006/0213411 A1 Sep. 28, 2006

(30) Foreign Application Priority Data

Mar. 25, 2005 (JP) ..... 2005-087771

(51) Int. Cl.
*D05B 83/00* (2006.01)
*D05B 73/12* (2006.01)

(52) U.S. Cl. ..... 112/261

(58) Field of Classification Search ..... 112/261, 112/258, 259, 260, 271, 217.3; 150/164; 160/369

See application file for complete search history.

(56) References Cited

U.S. PATENT DOCUMENTS

| | | | | |
|---|---|---|---|---|
| 2,570,705 | A * | 10/1951 | Pelletier | 112/261 |
| 3,019,751 | A * | 2/1962 | Fichera | 112/261 |
| 4,150,634 | A * | 4/1979 | Brown et al. | 112/275 |
| 4,269,127 | A * | 5/1981 | Kamiya | 112/122 |
| 5,520,128 | A * | 5/1996 | Rich et al. | 112/277 |
| 5,918,559 | A * | 7/1999 | Sakino | 112/261 |

FOREIGN PATENT DOCUMENTS

| | | |
|---|---|---|
| JP | U 61-198678 | 12/1986 |
| JP | A 11-267388 | 10/1999 |
| JP | A 2003-33596 | 2/2003 |

* cited by examiner

*Primary Examiner*—Ismael Izaguirre
(74) *Attorney, Agent, or Firm*—Oliff & Berridge, PLC

(57) ABSTRACT

A safety cover for a sewing machine of the present disclosure includes a transparent guard member shaped so as to cover at least a front side of a sewing needle, a fastening equipment for detachably attaching the guard member to a needle plate on an upper surface of the sewing machine bed.

10 Claims, 5 Drawing Sheets

SAFETY COVER FOR SEWING MACHINE

CROSS-REFERENCE TO RELATED APPLICATIONS

This application is based upon and claims the benefit of priority from the prior Japanese Patent Application No. 2005-087771, filed on, Mar. 25, 2005 the entire contents of which are incorporated herein by reference.

FIELD

The present disclosure relates to a safety cover for a sewing machine covering a sewing needle mounted to a needle bar of the sewing machine.

BACKGROUND

It has been conventionally suggested to provide a safety cover intended for use for example in a product display of a sewing machine. Such safety cover covers the front side of the sewing needle to prevent exterior contact; for instance, preventing a visitor from touching the sewing needle with his/her fingers.

A first related example disclosed in JP-Y-S61-198678 is a finger guard for a double-needle sewing machine. The disclosed finger guard is made of a metal wire and has a U-shaped curved portion surrounding the front side of the sewing needle and an arm extending to a sewing machine head side. The arm is mounted rotatably to the sewing machine head. Thus, the curved portion is arranged to be switchable between an operating position surrounding the front side of the sewing needle and a non-operating position retracted in the upward direction. However, since the finger guard of the first related example is formed by a metal wire, sufficient coverage cannot be secured to prevent the user's fingers from contacting the sewing needle.

Also, a second example JP-B-H11-267388 discloses a safety cover. The disclosed safety cover includes an arm rotatably connected to the lower end of the presser bar, a protection plate provided in the front end of the arm, and a lens attached to an opening of the protection plate. The protection plate is arranged to be switchable from an active position covering the front side of the sewing needle and a retracted position turned about a presser bar and retracted in the rear direction.

In the safety cover disclosed in the second related example, the protection plate covers a relatively large area of the front side of the sewing needle, therefore provides more safety as compared to the first related example. However, when attaching/detaching the safety cover to/from the sewing machine, the presser foot needs to be removed from the presser bar. Thus, the attachment/detachment of the safety cover is troublesome.

The finger guard and the safety cover of the first and the second related examples respectively, guards the front side of the sewing needle during a sewing operation also. However, some claim that it is sufficient to provide a safety cover upon product exhibition or for storage purposes (when the sewing machine is not used) and that the presence of the safety cover during the sewing operation is annoying. In either case, there is a need for a safety cover capable of being attached to/detached from the sewing machine with ease and which can be provided in a simple construction and low cost.

SUMMARY

The purpose of the present disclosure is providing a safety cover for a sewing machine capable of being attached to/detached from the sewing machine with ease and which can be realized in a simple construction and low cost.

The safety cover for a sewing machine of the present disclosure covers a sewing needle mounted on a needle bar of the sewing machine and is provided with a transparent guard member shaped such to cover at least the front side of the sewing needle and a fastening equipment detachably attaching the guard member to a needle plate on the upper surface of the sewing machine bed.

The safety cover of the sewing machine is detachably attached to the needle plate on the upper surface of the sewing machine bed via a fastening equipment and the transparent guard member is arranged to cover at least the front side of the sewing needle. No screws or tools are required upon attachment of the safety cover and the user need not remove any other parts upon attachment/detachment of the safety cover. Thus the safety cover can be easily attached to/detached from the sewing machine. Furthermore, the safety cover merely requires attachment to the upper surface of the needle plate, hence can be attached to various types of sewing machines and not limited to a specific type.

The guard member is constructed by a vertical wall covering the front and lateral sides of the sewing needle and a bottom wall provided with a fastening equipment. Since the lateral sides in addition to the front side of the sewing needle is covered by the guard member, higher protection is given to the sewing needle in avoiding contact with the user's fingers. An opening is provided in the bottom wall of the guard member for preventing guard member from interfering with a cloth feed dog that protrude and retract from the needle plate to feed a workpiece cloth. Thus, the attachment of the safety cover can be carried out even if the cloth feed dog is in the elevated position and also when the cloth presser foot disposed above the cloth feed dog is in the lowered position.

The safety cover for a sewing machine of the present invention is capable of being attached to a presser bar or a lower end of a sewing machine head with the guard member turned upside down, where the bottom wall thereof is disposed in the upper side. When the guard member is turned upside down, a small space through which a workpiece cloth can be passed is created between the guard member and the upper surface of the needle plate.

The attachment of the safety cover can be carried out in the desired disposition depending upon usage. For example, the safety cover can be attached to the needle plate in the normal use disposition when displaying the sewing machine in a store or for storage purposes when the sewing machine is not used As opposed to this, in case the safety cover is attached to the presser bar or the lower end of the sewing machine head by being turned upside down where the bottom wall is disposed in the upper side, a space is created above the needle plate. Since the workpiece cloth can pass through the space, sewing operation can be performed with the safety cover attached.

An edge of the opening of the bottom wall of the guard member is locked unmovably in the downward direction to the presser bar or the sewing machine head. Thus, the safety cover turned upside down can be attached easily. In the present disclosure, the fastening equipment is formed by a magnet. Since the needle plate is generally made of steel plate, the safety cover can be easily fixed thereon by the magnet, enabling the cost reduction of the fastening equipment.

In the present disclosure, the guard member is constructed by bending and assembling a flat sheet made of synthetic resin. Thus, the guard member can be provided in low cost and simple construction. Constructing the guard member by a single sheet provides even better cost performance.

If the guard member is arranged so as to be capable of being disassembled to the original flat surface, compact storage can be attained when the safety cover is removed (not used).

By providing a notch on the guard member for allowing the operation of the presser foot lifting lever, the operation of the presser foot lifting lever can be performed with the safety cover attached.

DETAILED DESCRIPTION OF THE PREFERRED EMBODIMENT

At least one of a plurality of embodiments of the present invention will be described hereinafter with reference to the drawings.

Figure 1:
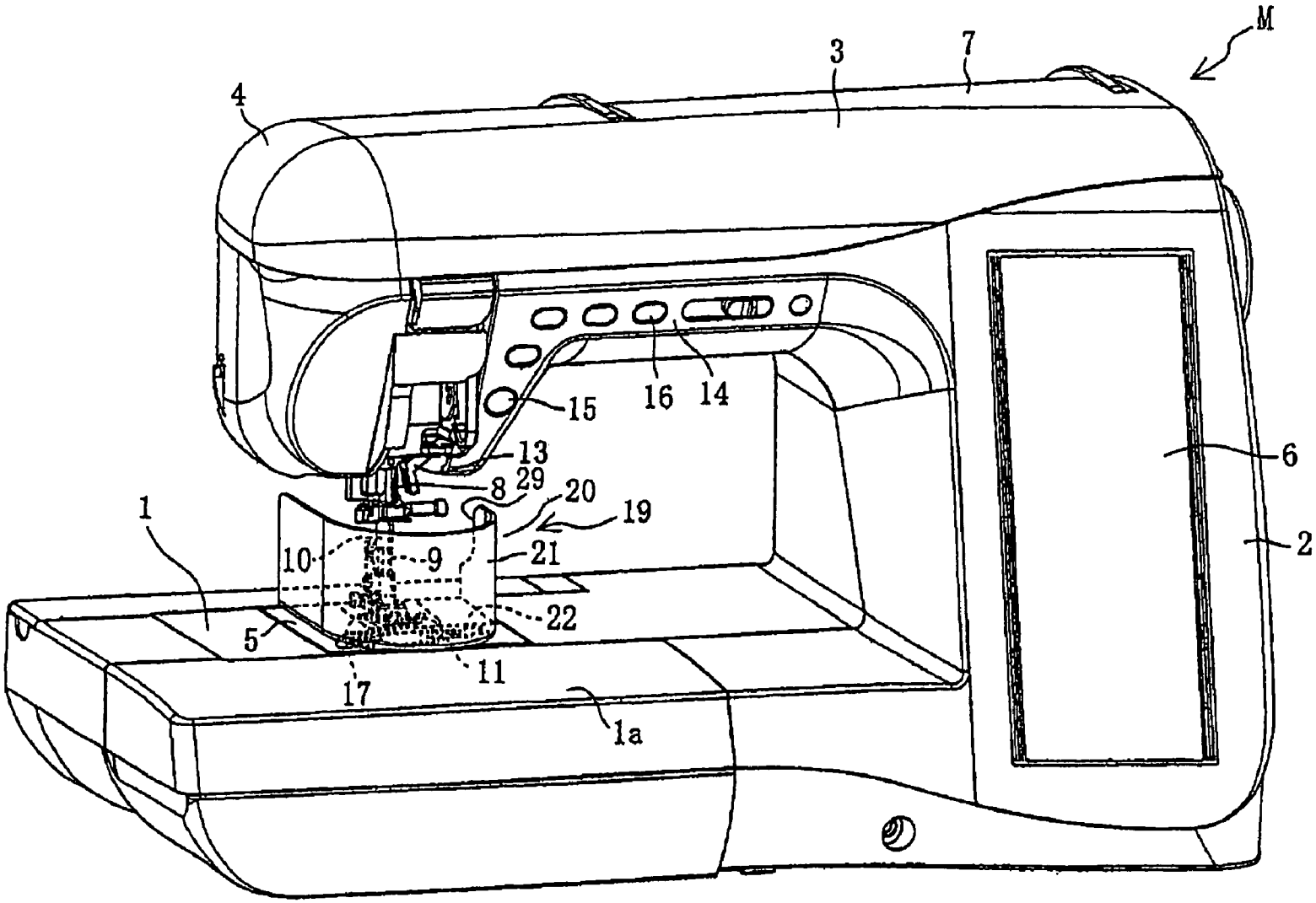
FIG. 1 is a perspective view of a sewing machine indicating an illustrative aspect of the present disclosure in which a safety cover is attached in a normal position.
Figure 2:
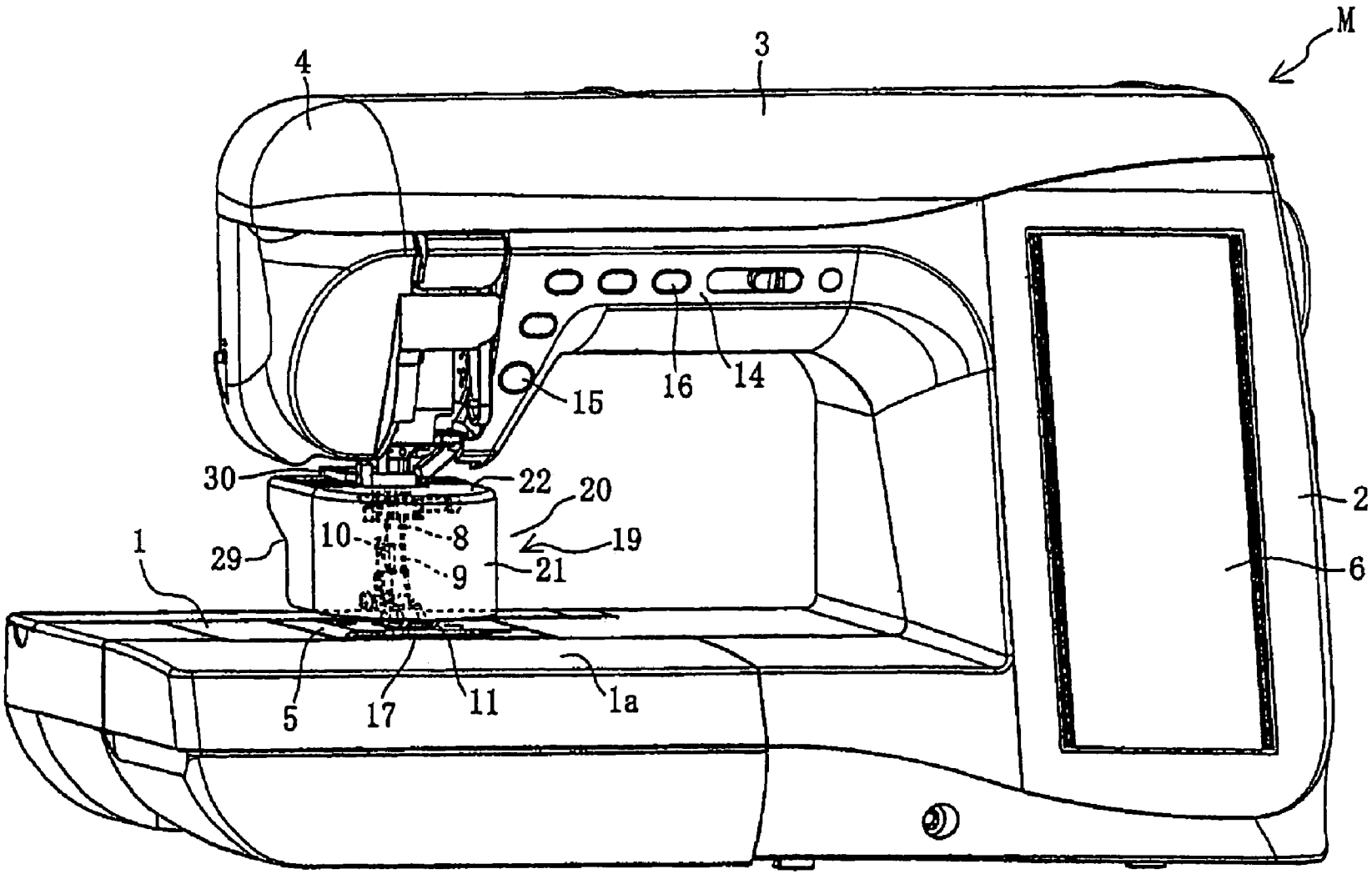
FIG. 2 is a perspective view of a sewing machine in which the safety cover is attached upside down.

FIGS. 1 and 2 illustrate an external appearance of the entire household electronic sewing machine M in accordance with the present embodiment. The sewing machine M includes a laterally elongated sewing machine bed 1, a foot 2 extending upward from the right side of the sewing machine bed 1, and an arm 3 extending to the left from the upper portion of the foot 2. A sewing machine head 4 is provided on the left end of the arm 3. The sewing machine bed 1 has a detachable auxiliary table 1*a* on the left front side thereof.

The arm 3 is mounted with an openable cover 7 covering the upper front side thereof. A front cover 14 is provided on the front side of the arm 3. A plurality of switches instructing a sewing start/end such as a start/stop switch 15, a thread cutting switch 16, and the like are provided on the front cover 14. A vertically oriented Liquid crystal display 6 is provided on the front surface of the foot 2.

A needle bar 8 having a sewing needle 9 mounted on the lower end thereof is provided vertically movably below the sewing machine head 4. Though not shown, a main shaft rotated by a sewing machine motor and a drive mechanism converting the main shaft rotation to a vertical movement of the needle bar 8 are provided inside the arm 3.

Figure 3:
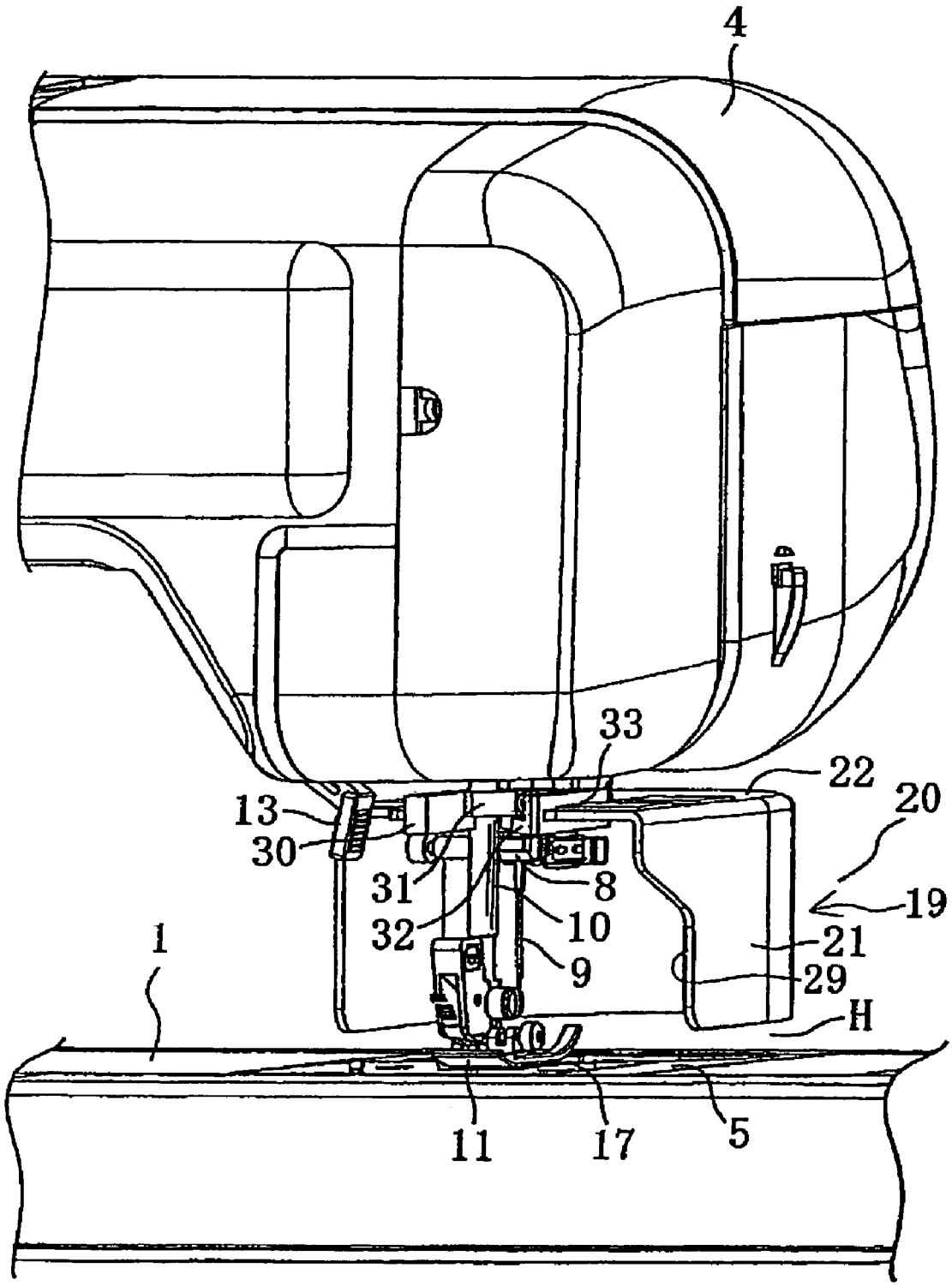
FIG. 3 is a perspective view of a main portion taken from the rear in which the safety cover is attached upside down.

Furthermore, as shown in FIG. 3, a presser bar 10 is provided behind the needle bar 8 below the sewing machine head 4. A presser foot 11 is attached to the lower end of the presser bar 10. A presser foot lifting lever 13 for vertically moving the presser bar 10 presser foot 11) manually is provided on the right side (left side in FIG. 3) thereof.

Figure 4:
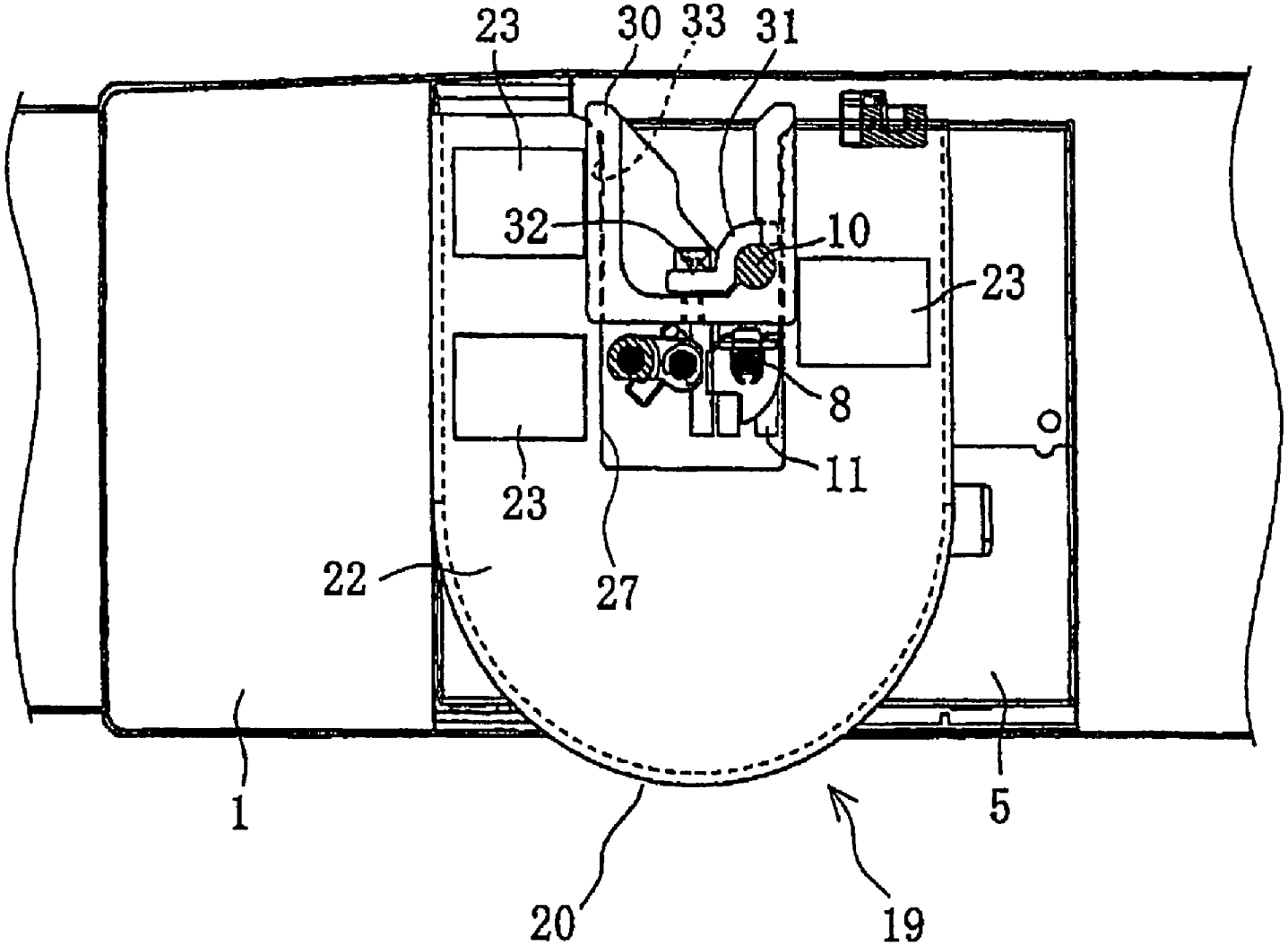
FIG. 4 is a transverse plan view of the main portion in which the safety cover is attached upside down.

As shown in FIGS. 3 and 4, a needle plate 5 made of for example, a steel plate is provided on the upper surface of the sewing machine bed 1. Though not shown, a thread cutting mechanism and a horizontal hook known in the art, and the like are provided inside the sewing machine bed 1 below the needle plate 5. A bobbin is detachably set to the horizontal hook mechanism. Also, though not shown, a cloth feed dog feeding the workpiece cloth in cooperation with the presser foot 11 by protruding and retracting from the needle plate 5, a feed dog drive mechanism for driving the cloth feed dog, and the like are provided inside the sewing machine bed 1.

The horizontal rotary hook mechanism and the feed dog drive mechanism are also driven in synchronization with the vertical movement of the needle bar 8 by the sewing machine motor.

In the above described sewing machine M, a safety cover 19 is detachably attached so as to avoid the user's fingers from touching the sewing needle 9. The safety cover 19 according to the present embodiment will be described in detail hereinafter with reference to FIG. 5. The safety cover 19 includes a guard member 20 made of transparent synthetic resin (for example ABS resin) and a fastening equipment 23 (refer to FIGS. 4 and 5) provided on the guard member 20.

The guard member 20 is integrally provided with a vertical wall 21 and a bottom wall 22 enclosing the bottom surface thereof, both of which are in a thin-plate form that cover the sewing needle 9 and the front and lateral sides of the peripheral space thereof. The front side of the vertical wall 21 is bent so as to reveal a forwardly protruding cylindrical surface (circumferential form when viewed from above or below) and the rear surface thereof is opened.

Therefore, the guard member 20 is formed as a box having an open top and rear. Also, as shown in FIG. 4, the bottom wall 22 has an opening 27 opened toward the rear from the center thereof. The opening 27 prevents the guard member 20 from interfering with the cloth feed dog (and the presser foot 11). Furthermore, on the right side of the guard member 20, more specifically on the upper rear-end portion thereof, a notch is formed for providing clearance in the right side of the presser foot lifting lever 13.

As oppose to this, the fastening equipment 23, as shown in FIG. 4, is made of for example, a rubber magnet (synthetic resin magnet) in an oblong thin-plate form. In the present embodiment, three fastening equipments 23 are adhered to three locations of the bottom wall 22 underside of the guard member 20 with an adhesive such as a two-sided tape (or a bond).

Figure 5:
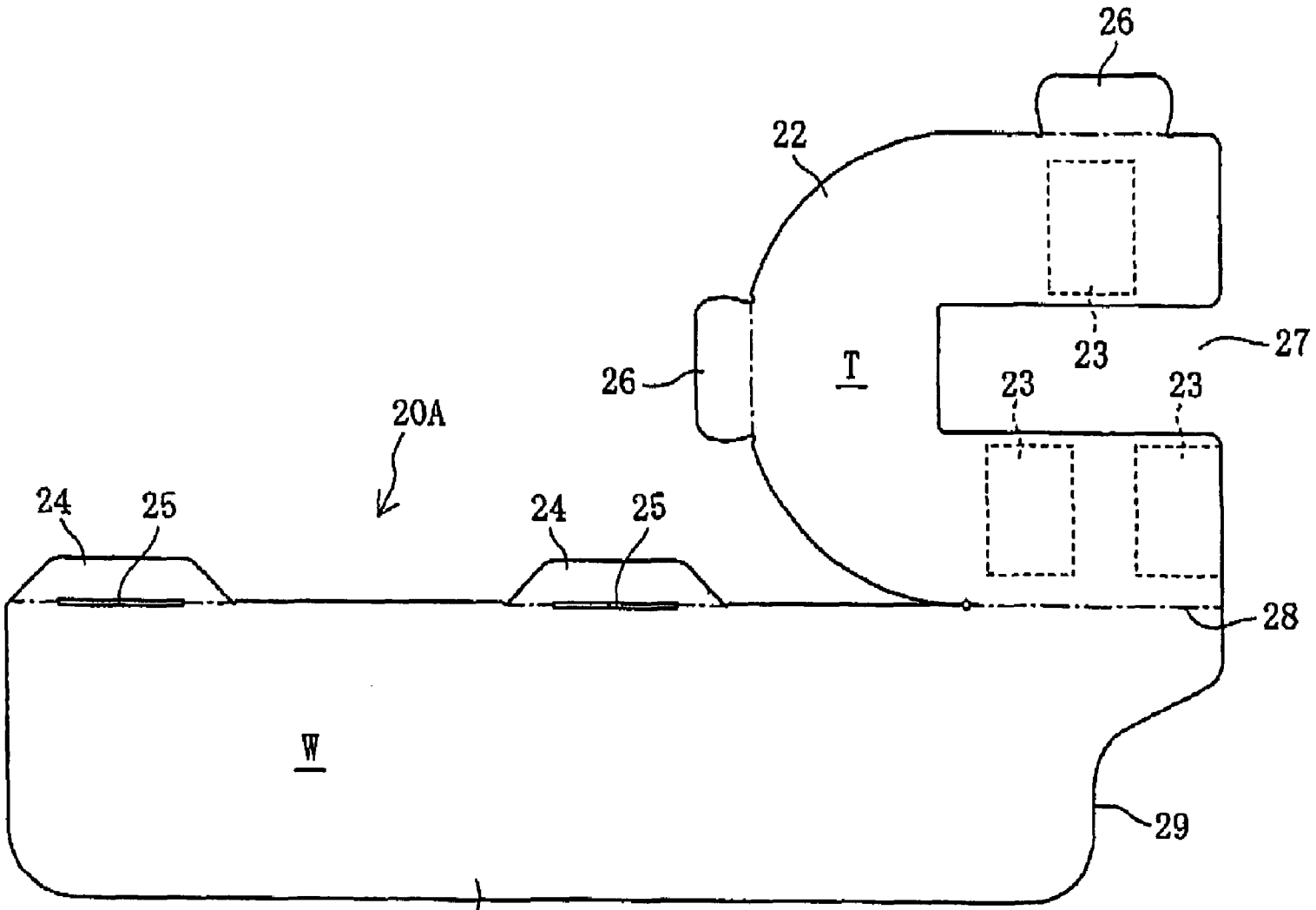
FIG. 5 is a plan view of an expansion of the safety cover.

A method of fabricating the guard member 20 will be described hereinafter. In the present embodiment, the guard member 20 is constructed by bending and assembling a single flat sheet made of synthetic resin (expansion 20A). FIG. 5 shows the shape of the expansion 20A constituting the guard member 20.

The expansion 20A is obtained by press cutting a flat sheet made of transparent synthetic resin with a mold. A flexible material having some degree of rigidity (elasticity) is preferable for the sheet, for example a resin sheet made of polypropylene having a thickness for example of 0.5 mm.

The expansion 20A is integrally provided with a vertical wall forming portion W in an elongated oblong form becoming of a vertical wall 21, and bottom wall forming portion T becoming of a bottom wall 22. The upper right end of the vertical wall forming portion W in FIG. 5 is connected to a part (right side) of the bottom wall forming portion T. The line of connection, defining a valley fold line 28, is folded in a right angle. The opening 27 is defined on the bottom wall forming portion T. Also, the notch 29 is formed on the vertical wall forming portion W.

Engagement pieces 26 are formed integrally in a protruding manner on the central portion of the circumferential portion of the front end (left in FIG. 5) and the rear portion (right side in FIG. 5) of the left end (upper edge in FIG. 5) of the bottom wall forming portion T respectively The border line (indicated in dash-dot line) between each engagement piece 2 and the bottom wall forming portion T (dash-dot line) is the valley fold line. Projections 24 corresponding to the engagement pieces 26 are integrally formed on the vertical wall forming portion W, more specifically on a long edge (upper edge in FIG. 5) that contact the bottom wall forming portion T after assembly (of the guard member 20).

A slit 25 to which the engagement pieces 26 are inserted is formed on each projection 24. The border line (dash-dot line) between each projection 24 and the vertical wall forming portion W is also a valley fold line.

When assembling a guard member 20 from the expansion 20A formed as described above, the vertical wall forming portion W and the bottom wall forming portion T are folded in a 90-degree valley fold along the valley fold line 28.

Each engagement piece 26 and projection 24 is folded into a 90-degree valley fold with respect to the bottom wall forming portion T and the vertical wall forming portion W respectively.

Thereafter, the vertical wall forming portion W is bent along the outer peripheral portion of the bottom wall forming portion T, and each engagement piece 26 is inserted respectively to each slit 25 from below (from above in FIG. 5).

Thus, the vertical wall forming portion W becomes of the vertical wall 21 and the bottom wall forming portion T becomes of the bottom wall 22 so as to form the guard member 20. The fastening equipment 23 may be adhered to the guard member 20 after assembly, or may be adhered to the location indicated by dash-dot line in FIG. 5 on the expansion 20A in prior to assembly.

Also, the assembled guard member 20 can be disassembled to the original expansion 20A in the sheet form by pulling out each engagement piece 26 from each slit 25 and unfolding the folded portions.

As will be mentioned in the following description on the operation of the embodiment, the safety cover 19 having the above construction is, as shown in FIG. 1, detachably attached to the upper surface of the sewing machine bed 1 by magnetically attracting the needle plate 5 to the fastening equipment 23 when in the normal position in which the bottom wall 22 assumes the underside of the guard member 20. Also, in the present embodiment, as shown in FIGS. 2 to 4, the guard member 20 can be used upside down, being vertically inversed from the normal position (left and right are reverse but front and back are unchanged). As will be described hereinafter, in case the safety cover 19 is attached upside down, a space H (refer to FIG. 3) allowing the workpiece cloth to pass therethrough is created between the safety cover 19 and the upper surface of the needle plate 5. An attachment equipment 30 and the auxiliary equipment 31, or the like are used upon attachment of the safety cover 19 turned upside down.

Next, the operation of the safety cover 19 having the above construction will be described hereinafter. For example, in case of displaying the sewing machine M in a store, or when the sewing machine M is not used, as shown in FIG. 1, the safety cover 19 can be attached to the needle plate 5 in the normal position in which the bottom wall 22 of the guard member 20 assumes the underside of the safety cover 19. Upon attachment of the safety cover 19, the user is to insert the safety cover 19 from the front side such that opening 27 in the bottom wall 22 of the guard member 20 is disposed in a position to embrace the presser foot 11 and the fastening equipment 23 is attracted to the needle plate 5.

When the safety cover 19 is attached in such state, since a large area of the front and lateral sides of the sewing needle 9 is covered by the guard member 20, the sewing needle can be effectively prevented from contacting the user's fingers. Also, owning to the opening 27 in the bottom wall 22 of the guard member 20, the safety cover 19 can be attached even when the cloth feed dog is elevated as well as when the cloth presser foot 11 arranged above the cloth feed dog is lowered.

Furthermore, since the notch 29 is formed on the vertical wall 21 of the guard member 20, the user is able to operate the presser foot lifting lever 13 with ease with the safety cover 19 attached. Since the guard member 20 is transparent, the sewing needle 9, the needle bar 8, the presser foot 11, and the like are visible. Also, the safety cover 19 can be easily removed from the sewing machine M by pulling off the fastening equipment 23 made of a magnet from the needle plate 5.

As opposed to this, in case a sewing operation needs to be performed with the safety cover 19 attached, as shown in FIGS. 2 to 4, the safety cover 19 can be attached upside down to the sewing machine M. Upon attaching the safety cover 19 upside down, as shown in FIGS. 3 and 4, the attachment equipment 30 is mounted on the upper portion (underside of the sewing machine head 4) of the presser bar 10 of the sewing machine M.

The attachment equipment 30, as shown in FIG. 4, is formed in a U-shape opened in the rear direction when view from above, and an insertion groove 33 forming a horizontal groove to which the inner edge of the opening 27 in the bottom wall 22 of the guard member 20 is inserted is formed in the lateral edges of the attachment equipment 30. As shown in FIG. 4, the attachment equipment 30 is fixed horizontally with respect to the presser bar 10 by placing the inner right corner thereof in contact with the presser bar 10 and disposing the auxiliary equipment 31 such to clamp the presser bar 10 with the attachment equipment 30. The auxiliary equipment 31 is secured to the presser bar 10 by a bolt 32.

Then the safety cover 19 is turned upside down such that the opening 27 in the bottom wall 22 of the guard member 20, more specifically, the lateral edges thereof are inserted into the insertion groove 33 of the attachment equipment 30 from the front. Thus, the bottom wall 22 of the guard member 20 is locked to the attachment equipment 30 unremovably in the downward direction. Thus, the safety cover 19 is attached to the presser bar 10. The needle bar 8, presser bar 10, and the like are disposed inside the opening 27.

When the safety cover 19 is attached upside down, the front and lateral sides of the sewing needle 9 are covered by the vertical wall 21. As shown in FIG. 3, since the space H is formed between the upper surface of the sewing machine bed 1 (needle plate 5) and the lower end of the guard member 20, sewing operation can be performed with the safety cover 19 attached. The safety cover 19 can be easily removed by pulling the safety cover 19 toward the front and removing the lateral edges of the opening 27 of the bottom wall 22 from the lateral insertion groove 33 of the attachment equipment 30.

The safety cover 19 according to the present embodiment provides the following effects.

When the safety cover 19 is attached to the sewing machine M, a large area of the front and lateral sides of the sewing needle 9 is covered by the vertical wall 21 of the guard member 20. Thus, the sewing needle 9 can be effectively prevented from contacting the user's fingers.

Also, the safety cover 19 can be attached/detached without any tools or the like therefor, and without removing any other parts.

As a result, the safety cover 19 can be easily attached to/detached from the sewing machine M. In the normal position, the attachment/detachment of the safety cover 19 can be carried out very easily since the fastening equipment 23 made of magnet can be attached to the upper surface of the needle plate 5 by magnetic attraction. The safety cover 19 can be generally used to various types of sewing machines and not limited to the use with specific type of sewing machine M.

Moreover, particularly in the present embodiment, since the safety cover 19 can be used upside down, the safety cover 19 can be attached in a desired disposition depending upon the usage. Not only does the safety cover 19 provide safety upon displaying the sewing/machine M in a store or storing the sewing machine after completion of a sewing operation, but also enables the performance of a sewing operation while securing safety with the safety cover 19. The safety cover 19 can be attached/detached upside down very easily.

Furthermore, the safety cover 19 of the present embodiment is constructed by forming the guard member 20 by bending and assembling a single flat sheet (expansion 20A) made of synthetic resin. Thus, the guard member 20 can be constructed simply and with low cost. Adopting a magnet for the fastening equipment 23 provides low cost as well. Thus, the safety cover 19 as a whole can be provided in low cost. Also, since the guard member 20 can be unfolded to the original flat state, compact storage is provided when the safety cover 19 is removed (not used).

Next, partial modifications of the above embodiment are described hereinafter.

In the above embodiment, the guard member 20 is formed by bending and assembling a single flat sheet. Alternatively, the vertical wall 21 and the bottom wall 22 may be provided as separate parts and joined together by an adhesive, welding, screwing, eyelet fastening, or the like. The entire guard member 20 may be integrally formed by an injection molded synthetic resin. The ingredient of the guard member 20 is not limited to ABS resin but the use of a polypropylene, a polyethylene and various resin material is possible.

The fastening equipment 23 need not be rubber magnet but may be a sinter formed ferrite magnet, or the like. Yet, as another alternative, a suction disc, an adhesive tape, a mating surface fastener, or the like may be used instead of the magnet. The fastening equipment 23 is not limited to provision in three locations but can be provided in one or a plurality of locations.

The guard member 20 only needs to be in such shape to cover at least the front side of the sewing needle 9. The front surface of the vertical wall 21 does not necessarily have to be curved. The safety cover 19 may be attached upside down by providing a locking hook on the underside of the sewing machine head 4 for locking the guard member 20 thereto.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

What is claimed is:

1. A safety cover for a sewing machine mounted so as to cover a sewing needle mounted on a needle bar of the sewing machine, the safety cover comprising:

a transparent guard member mounted in close proximity of the sewing needle and shaped so as to cover at least a front side of a sewing needle and a fastening equipment for detachably attaching the guard member directly to a needle plate on a sewing machine bed upper surface.

2. The safety cover according to claim 1, wherein the guard member comprises a vertical wall covering a front side and lateral sides of the sewing needle and a bottom wall provided with the fastening equipment thereon.

3. The safety cover according to claim 2, wherein the bottom wall of the guard member has an opening for preventing the guard member from interfering with a cloth feed dog feeding a workpiece cloth by protruding/retracting from the needle plate.

4. The safety cover according to claim 2, wherein the guard member is attachable to a presser bar or a lower end of a sewing machine head by being turned upside down where the bottom wall is disposed to an upper side, and the guard member and an upper surface of the needle plate define a space therebetween through which a workpiece cloth can be passed.

5. The safety cover according to claim 4, wherein an edge of the opening in the bottom wall of the guard member is locked to the presser bar or the sewing machine head so as to be unremovable in a downward direction.

6. The safety cover according to claim 1, wherein the fastening equipment comprises a magnet.

7. The safety cover according to claim 1, wherein the guard member is constructed by bending and assembling a flat sheet made of synthetic resin.

8. The safety cover according to claim 7, wherein the guard member can be disassembled to an original flat surface.

9. The safety cover according to claim 7, wherein the guard member comprises a single sheet.

10. The safety cover according to claim 1, wherein the guard member has a notch allowing an operation of a presser foot lifting lever.

* * * * *